United States Patent [19]

Grant

[11] Patent Number: 5,047,089

[45] Date of Patent: Sep. 10, 1991

[54] DEVICE AND METHOD FOR REMOVING ASBESTOS-CONTAINING MATERIAL FROM A SURFACE

[76] Inventor: Jerrel Grant, 5915 Flintrock, #403, Houston, Tex. 77040

[21] Appl. No.: 344,127

[22] Filed: Apr. 26, 1989

[51] Int. Cl.[5] ..... B08B 1/00; B08B 3/04; B08B 13/00

[52] U.S. Cl. ..... 134/21; 15/364; 15/383; 51/273; 134/32; 134/25.1; 210/416.1; 210/513

[58] Field of Search ..... 15/364, 383, 322; 51/273; 134/6, 32, 33, 25.1, 25.4; 210/513, 416.1

[56] References Cited

U.S. PATENT DOCUMENTS

| | | | |
|---|---|---|---|
| 3,711,891 | 1/1973 | Conway | 15/321 |
| 3,843,198 | 10/1974 | Reynolds | 299/18 |
| 4,158,575 | 1/1979 | Townsend | 134/6 |
| 4,274,676 | 6/1981 | Chapel | 299/64 |
| 4,438,977 | 3/1984 | Chapel | 299/64 |
| 4,547,928 | 10/1985 | Ludscheidt | 15/364 |

*Primary Examiner*—Asok Pal

*Attorney, Agent, or Firm*—Alton W. Payne; Daniel N. Lundeen

[57] ABSTRACT

A device for removing and cleaning asbestos containing material from a surface is disclosd. The device has a housing which is moved in a path to clear a swath of asbestos-containing material from a surface. A plurality of knives are positioned on an open face of the housing to make a plurality of incisions in the asbestos-containing material layer as the housing is moved along the surface. A scraping blade trailing the knives scrapes the asbestos-containing material from between the incisions. A sheet of water from a pressurized source is sprayed onto the scraped surface at an oblique angle to wash residual asbestos-containing material from the surface. The liquid spray and asbestos-containing material is aspirated together by a vacuum source connected to the housing, and the mixture of liquid and asbestos-containing material is removed in a separating receptacle.

18 Claims, 4 Drawing Sheets

DEVICE AND METHOD FOR REMOVING ASBESTOS-CONTAINING MATERIAL FROM A SURFACE

FIELD OF THE INVENTION

The present invention relates to a device and method for removing and cleaning a relatively softer material, such as asbestos, from a relatively harder surface, such as, walls and ceilings.

BACKGROUND OF THE INVENTION

Asbestos was once a popular and widely used insulating material. However, it is now known that asbestos is a hazardous material and wide scale efforts have been undertaken to remove asbestos from commercial, industrial and residential buildings and other installations, such as, for example, schools, hospitals, office buildings, homes and the like. Methods heretofore available for removing asbestos from the walls, ceilings and other surfaces of such structures have heretofore been expensive and laborious. Most commonly, asbestos-containing material is first wetted and scraped from the surface on which it was deposited. This scraping is usually done manually, and because of the potential risk of exposure of personnel to asbestos materials during the scraping procedure, the personnel are required to wear protective clothing and breathing apparatus. Following the scraping procedure, the surface must be washed, again by hand, to remove any residual asbestos containing material that may not have been removed by the scraping procedure. Considerable effort and care is directed to making sure that all of the scraped material and washing solution is collected and disposed of, and not permitted to escape from containment. This overall procedure is quite laborious, and can require labor upwards of one man hour per square foot of surface from which asbestos containing material is to be removed.

It is known from U.S. Pat. Nos. 4,274,676 and 4,438,977, both to Chapel, to use an apparatus for removing material such as asbestos from a surface by sealing the edges of the apparatus against the surface so that the removed material will not escape into the ambient environment. This apparatus treats the material to be removed with a coagulant and then, subsequently or simultaneously with the coagulant treatment, cuts, scrapes and loosens the material from the surface. The loosened and coagulated material is then removed from the apparatus by suction.

In U.S. Pat. No. 3,843,198, to Reynolds, there is disclosed a rock sampling tool which uses a compressed air driven rock cutting wheel and entrains dust formed thereby in an air stream that is drawn into a shroud around the cutting wheel. The dust is separated from the air in a cyclone separator.

In U.S. Pat. No. 3,711,891 to Conway, there is described a carpet cleaning device which first sprays the carpet to be cleaned with a cleaning solution, vibrates the carpet and then exposes the carpet to vacuum to remove cleaning solution and dirt from the carpet.

As far as applicant is aware, there is no prior art disclosing an apparatus or method wherein an asbestos containing material layer on a surface can be cleaned by sequentially cutting, scraping and water spraying the asbestos-containing material layer, while simultaneously aspirating the asbestos-containing material and sprayed water together into a collection receptacle so that release of asbestos particles into the ambient atmosphere is minimized.

SUMMARY OF THE INVENTION

In one aspect of the invention, there is provided a device for removing and cleaning a relatively softer material from a relatively harder surface. The device has a housing with an open face for movement along a surface having a soft material layer deposited thereon. Means are associated with the open face of the housing for making a plurality of incisions in the soft material layer as the open face is moved against the surface to be cleaned. Means are associated with the open face for scraping the soft material layer between the incisions from the surface to remove the bulk of the soft material therefrom. Means are associated with the housing for then washing the surface to remove residual soft material therefrom. Means are associated with the housing for simultaneously aspirating the removed and washed soft material together into a collection receptacle.

In another aspect, the invention provides a device for removing and cleaning asbestos-containing material from a surface onto which the asbestos-containing material has been deposited. The device includes a housing adapted to move or to be moved in a longitudinal path along a surface coated with an asbestos-containing material layer. A plurality of knives are disposed adjacent a leading side of the housing for making longitudinal and generally continuous incisions in the asbestos-containing material layer as the housing is moved along the surface to be cleaned. There is a blade disposed transversely to the longitudinal incisions, and trailing the knives, for scraping the bulk of the asbestos-containing material layer between the incisions from the surface to be cleaned. A distributor is mounted to the housing for spraying liquid from a pressurized source thereof onto the scraped surface to wash or remove residual asbestos-containing material from the surface. A vacuum source is connected to the housing for aspirating the sprayed liquid and the asbestos-containing material removed by the cutting, scraping and washing.

A further aspect of the invention is the provision of a method of removing and cleaning soft material from a surface. The method includes the step of making a plurality of incisions in a soft material layer deposited onto a relatively harder surface. The soft material layer between the incisions is then scraped from the surface. The method also includes washing the scraped surface to remove residual soft material therefrom, and aspirating any wash solution and the removed soft material together into a collection receptacle.

A still further aspect of the invention is the provision of a method for removing and cleaning asbestos from a surface. This method includes the steps of making a plurality of parallel incisions in a layer of an asbestos-containing material deposited onto a surface, and scraping the asbestos-containing material layer between the incisions from the surface. The method also includes the steps of spraying liquid from a pressurized source thereof onto the scraped surface to remove residual asbestos-containing material therefrom and aspirating the sprayed liquid and the removed asbestos-containing material together into a collection receptacle.

BRIEF DESCRIPTION OF THE DRAWINGS

FIG. 2A is an enlarged view of a portion of the device of FIG. 2 showing a knife formed on an outermost edge of a longitudinal side wall.

DETAILED DESCRIPTION OF THE PREFERRED EMBODIMENTS

Figure 1:
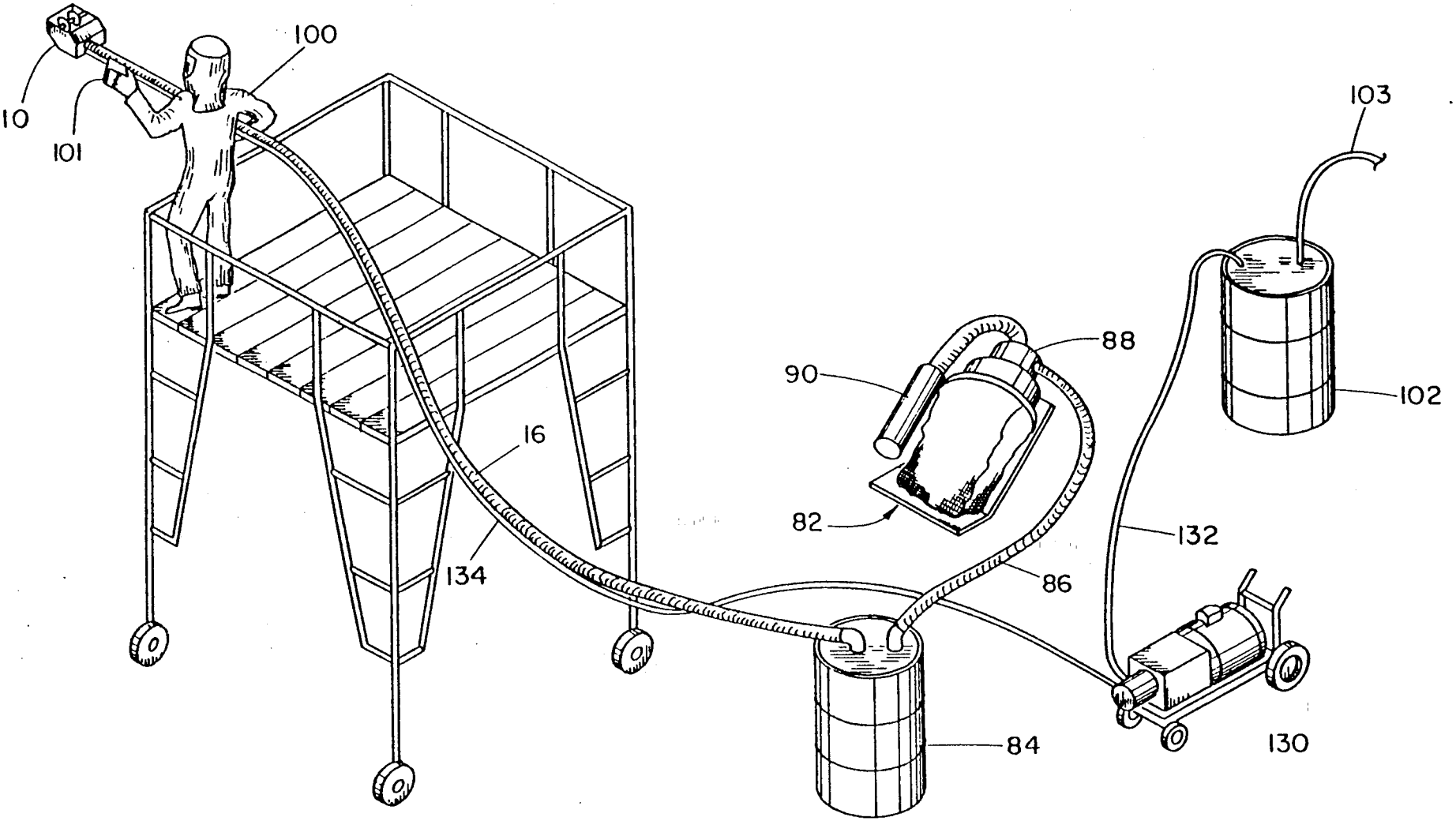
FIG. 1 is a schematic illustration of a device and a process according to the present invention.

Referring now to the figures, in which like reference numerals are used to indicate like parts, a preferred embodiment of the invention, schematically illustrated in FIG. 1, includes a specially designed surface cleaning head 10 for removing a material from a surface and cleaning the surface to remove residual material therefrom by sequentially or simultaneously cutting and scraping the soft layer and washing the exposed surface. Water or other liquid from a reservoir 102 is supplied to a pump 130 via line 132, and thence to cleaning head 10 by means of line 134 connected to the discharge of pump 130 wherein it is used for washing the scraped surface The removed material and the wash water is aspirated from cleaning head 10, and the air-entrained mixture is withdrawn through vacuum hose 16 into separator 84 wherein the water/material mixture is disengaged from the air which is in turn discharged through line 86 into vacuum unit 82 including particulate filter 90.

The material to be removed from the surface may be generally any material which is softer than the surface from which it is to be removed. The cleaning head 10 is particularly adapted to remove asbestos-containing material from a surface, and especially pre-wetted asbestos-containing material. Reference is made hereinbelow to asbestos-containing material as a preferred embodiment of a softer material to be removed from a relatively harder surface, but it will be understood that such reference is for the purpose of brevity and clarity in illustrating an exemplary embodiment, and that the apparatus and method of the invention is not so limited in application.

Figure 2:
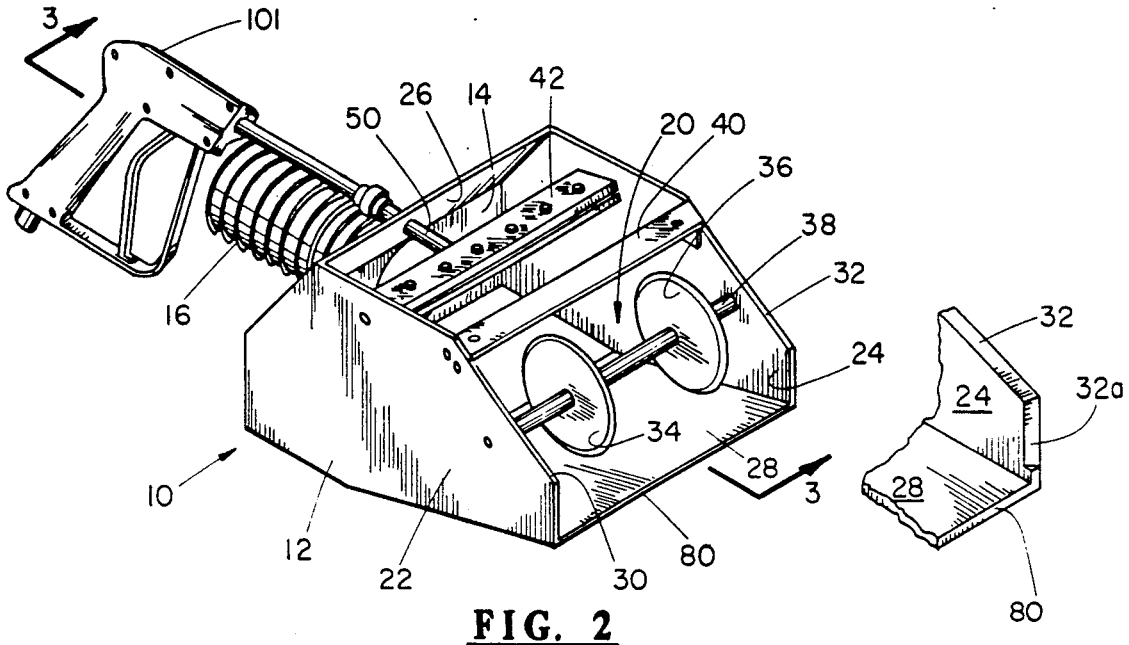
FIG. 2 is a perspective view of an asbestos-containing material removal device according to the present invention.
Figure 3:
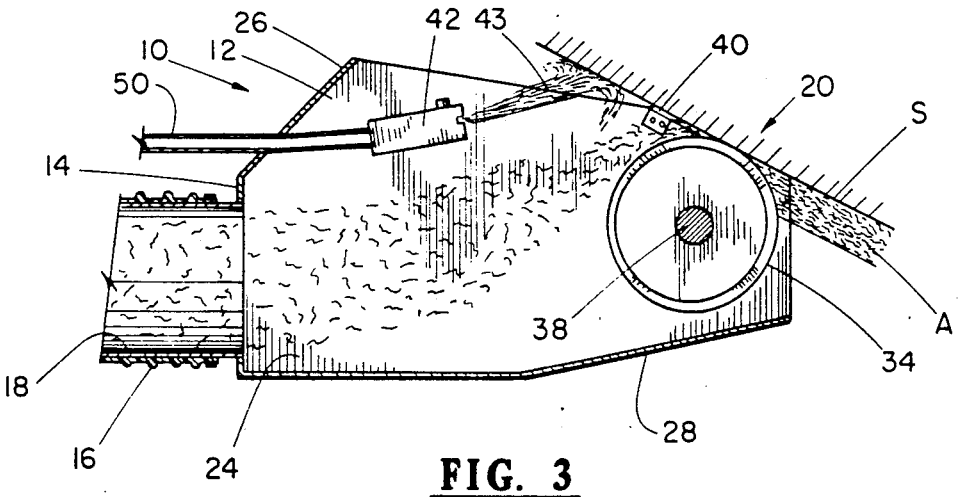
FIG. 3 is a side sectional view, of the device of FIG. 2 as seen along lines 3—3.

As best illustrated in FIGS. 2 and 3, the cleaning head 10 includes a housing 12 which houses various cutting, scraping and washing elements therein, as described in more detail hereinafter. The housing 12 includes a base wall 14 at which a vacuum hose 16 is connected onto a protruding sleeve 18. An open face 20 is defined by longitudinal side walls 22 and 24, and end walls or panels 26 and 28, depending from base wall 14 so as to enclose the housing 12 and shroud the open face 20.

A plurality of knives 30, 32, 34 and 36 are positioned at a leading side of the housing 12 at the open face 20 so that when the housing 12 is moved in a path along the surface to be cleaned, and held or pressed against such surface, the knives 30, 32, 34 and 36 will tend to cut the asbestos-containing material layer into longitudinal strips separated by parallel incisions. Knives 30 and 32 are disposed at the outermost edges of the longitudinal side walls 22 and 24, respectively. Knives 30 and 32 may be formed on the edges of the longitudinal side walls 22 and 24, for example, by beveling and sharpening the edges thereof at 32*a* as best seen in FIG. 2A, or by securely affixing a longitudinally oriented cutting surface thereto. Additional knives 34 and 36 may be spaced between the longitudinal side walls 22 and 24. Preferably, these intermediately spaced knives 34 and 36 are wheel knives comprising circular disks with sharpened outer edges which are rotatably fixed on a shaft 38 having opposite ends thereof mounted to longitudinal side walls 22 and 24. The intermediate knives 34 and 36 should be positioned such that the cutting edges are flush with the cutting edges of the knives 30 and 32 disposed on the outermost edges of the longitudinal walls 22 and 24 so that incisions of about equal depth are made as the cleaning head 10 is moved longitudinally across the surface to be cleaned. The spacing and number of the knives is not particularly critical, but it is preferred that the spacing between the knives 30, 32, 34 and 36 be less than the diameter of the vacuum hose 16 and sleeve 18 to facilitate avoiding the vacuum hose 16 becoming plugged by the aspiration of relatively large pieces or chunks of the asbestos-containing material therethrough.

Figure 4:
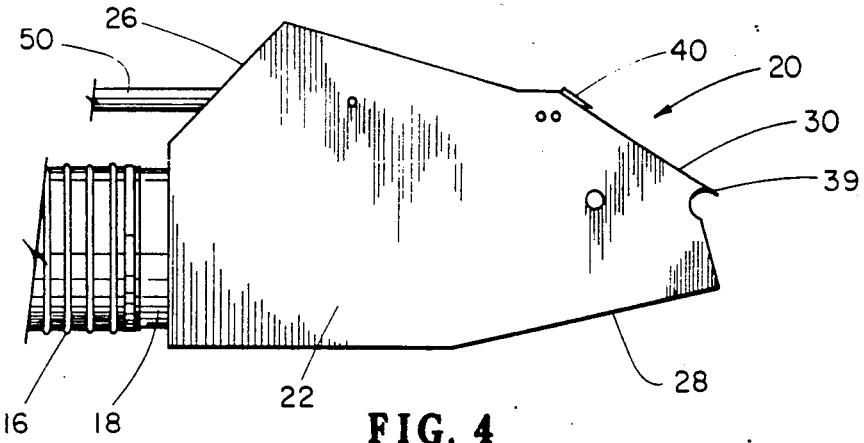
FIG. 4 is a side view, of an alternate embodiment of the device of FIG. 3.

In an alternate embodiment best seen in FIG. 4, the knives 30′ and 32′ include a leading double edged section 39 tapered into a leading tip which facilitates making the incisions as deep as possible by tending to push and hold the blades 30′, 32′, 34 and 36 against the underlying surface to be cleaned. The embodiment works well with relatively smooth surfaces, but the embodiment of FIGS. 2 and 3 is preferred when rough or textured surfaces are involved which may tend to catch on the tip 39.

On a trailing side of the knives 30, 32, 34 and 36, there is affixed a scraping device such as transverse blade 40 by, for example, securing opposite ends thereof to an outermost edge of respective longitudinal walls 22 and 24 by clamping, bolting, welding, riveting, etc. The blade 40 should have a sharp leading edge for efficient scraping of the surface to be cleaned, and may be made of any material suitable for this purpose. The blade 40 may be flat for engaging and scraping against a smooth or textured surface, but may alternatively be shaped to correspond to other regular surfaces, e.g. the blade 40 may be made sinusoidally shaped to complement conventional corrugated steel surfaces for use therewith.

A distributor or spraying head 42 is positioned in the housing to direct a high velocity jet 43 (see FIGS. 7 and 8) of water, or other suitable liquid, with any desired additives, behind a trailing edge of the blade 40. Any suitable spraying devices may be employed for this purpose, but the spray or jet 43 is preferably in the form of a sheet or film directed to impinge immediately behind and adjacent the blade 40, e.g. about ½ inch behind the blade 40, across the entire width between the longitudinal side walls 22 and 24 of the housing 12. Preferably, the jet impinges on the surface to be cleaned at an oblique angle with respect thereto, e.g at about 45 degrees so that the spray is directed or reflected toward the blade 40, to enhance the washing action of the jet 43. The velocity of the liquid in the jet 43 should be as high as practicable to enhance cleaning of the surface by impingement thereon, but should not be too high to facilitate avoiding damage to the surface below the asbestos-containing material layer and/or escape of asbestos particles discharged from the surface being cleaned at a higher velocity than the aspirating air. Low impingement velocities are to be avoided as insufficient cleaning is achieved by the impingement of the liquid against the surface to be cleaned.

Figure 7:
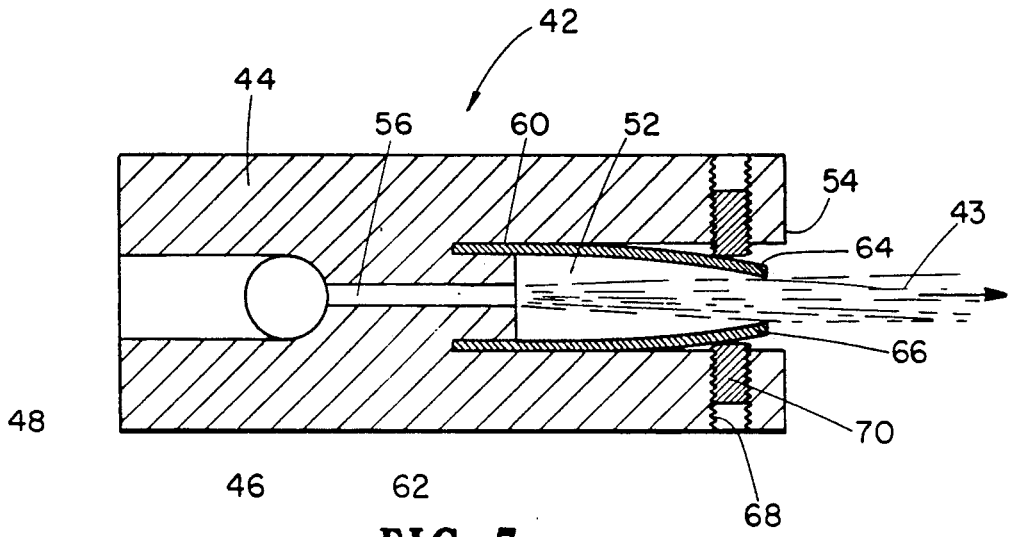
FIG. 7 is an enlarged side sectional view of a liquid spraying device according to the present invention.
Figure 8:
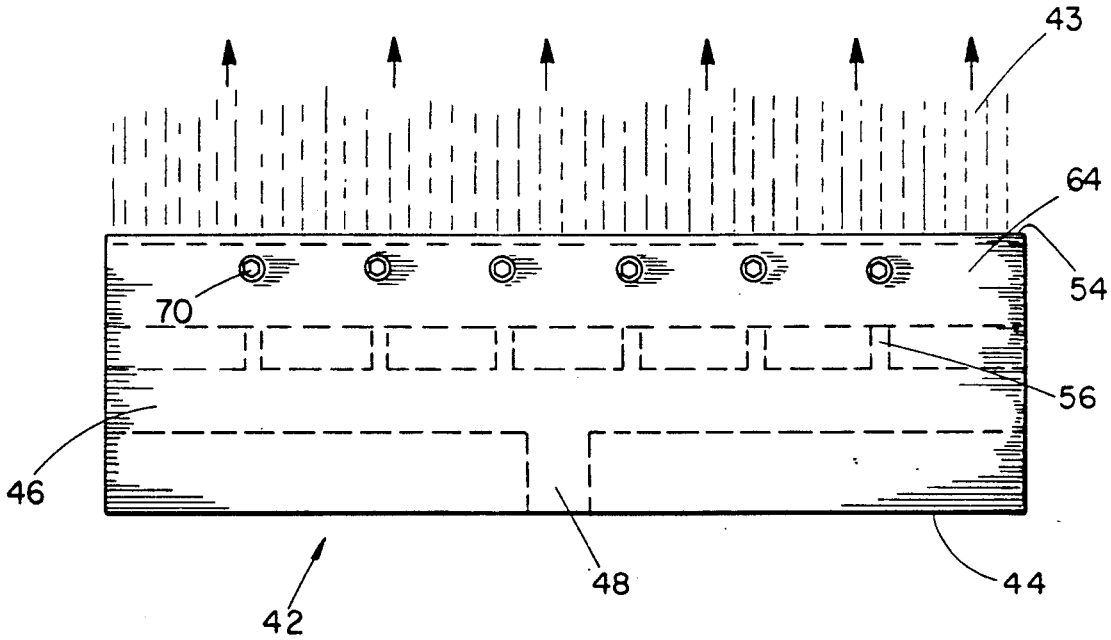
FIG. 8 is a plan view of the spraying device of FIG. 7.

In a preferred embodiment, as best illustrated in FIGS. 7 and 8, the water distributor 42 is desirably made from a bar 44 of a suitable material, e.g. aluminum, stainless steel or the like. A longitudinal bore 46 is formed through the length of the bar and sealed at each end thereof, e.g. by threadedly engaged bolts or screws (not shown). A relatively large transverse bore 48 is formed in fluid communication with the longitudinal bore 46 to supply water or other liquid thereto through a pipe or a conduit 50 which may be welded or threadedly connected to the transverse bore 48 at one end and extended through wall 26 at the other for connection to water supply line 134.

A channel 52 is formed in a surface 54 of the bar 44 along the length thereof. A plurality of orifices 56 are drilled along a bottom surface 58 of the channel 52 and are in fluid communication between the channel 52 and the longitudinal bore 46. Alternatively, the orifices 56 could be predrilled in inserts or assemblies which are threadedly or otherwise received in larger bores formed in place of the drilled orifices 56. Recesses 60 and 62 are formed on each side of the channel 52 adjacent the bottom surface 58 for receiving respective plates 64 and 66 along the length of the channel 52 which are press fit into the recesses 60 and 62. The size and shape of the water jet 43 can be adjusted by means of a plurality of set screws 68 positioned in threaded bores 70 which open to the channel 52 adjacent the respective plates 64 and 66 along the length of the distributor 42. The jet 43 is made narrower by compressing the plates 64 and 66 with the set screws 68, and wider by backing off the set screws 68, as desired. Spacing of 0.013-inch orifices 56 one inch apart and ½ inch from the longitudinal side walls 22 and 24 of the cleaning head 10, and a corresponding positioning of the set screws 68 has been found to be suitable. A gap between the plates 64 and 66 at discharge of about 0.008–0.009 inches produces a narrow plane, sheet or film of water 43 directed against the surface to be cleaned, much like a "knife" made of water, using approximately 1.5 gallons per minute of water supplied at from about 2,500 to about 3,000 psi.

Alternatively, other spray patterns, such as a plurality of overlapping conical spray patterns, could be used, provided that the entire surface between the longitudinal side walls 22 and 24 at some point behind the trailing side of the scraper blade 40 is covered, but these are less efficient and therefore less preferred. Spray nozzles employing air or gas atomization could also be used, but airless spraying systems are preferred since any air introduced in the washing system will reduce the velocity of air entering across the edges of the open face 20 of the cleaning head 10 for entraining and aspirating the water and asbestos containing material.

There is preferably a gap or clearance between an edge 80 of the end wall 28 and the outermost edges of longitudinal walls 22 and 24 of the housing 12 to permit clearance between the edge 80 of the wall 28 and the layer of asbestos-containing material to be removed from the asbestos-containing material layer A on the surface S. Such asbestos-containing material has typically been deposited on the surface to be cleaned in a layer of from about ⅜ up to 2 inches in thickness or more. There may be a similar gap or clearance formed at a trailing side of the housing 12 to facilitate manipulation of the head 10 at uneven or irregular portions of the surface from which the asbestos-containing material layer is being removed. The gaps at the leading and trailing sides of the housing 12 should not be too large to facilitate a relatively high velocity of air passing therethrough to obtain entrainment therein of asbestos material and water (from the sprayer) and to inhibit possible escape of asbestos-containing material from the cleaning head 10 at these gaps.

Figure 5:
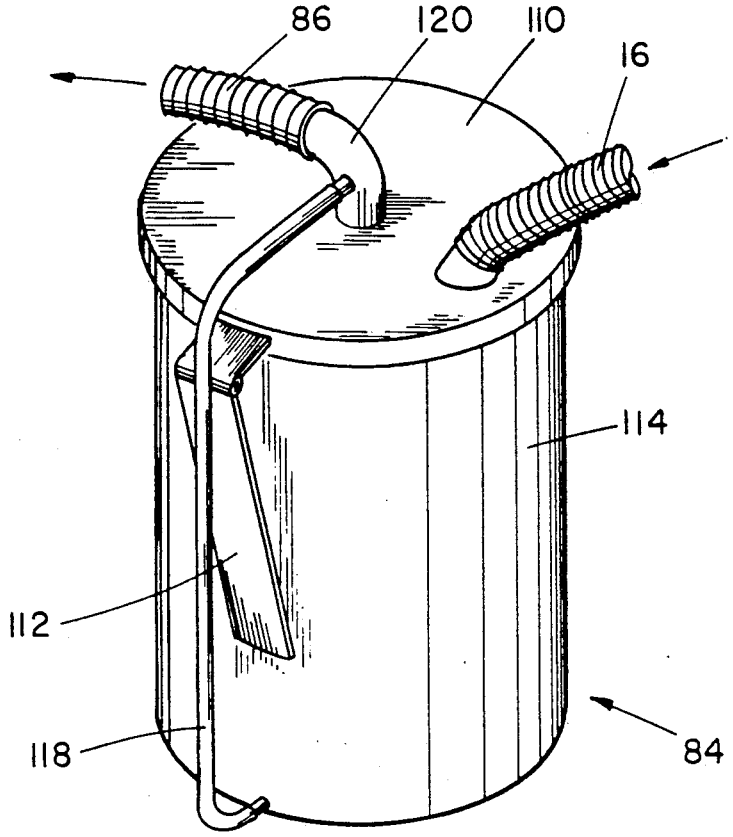
FIG. 5 is a perspective view of a separator according to the present invention.
Figure 6:
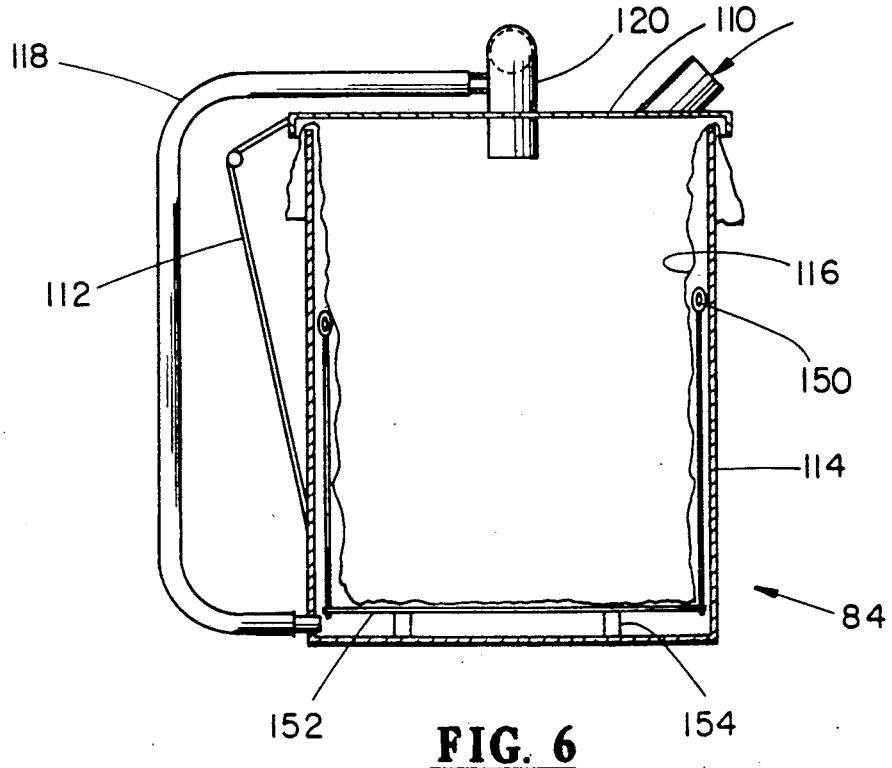
FIG. 6 is an elevation of the separator of FIG. 5.

The housing 12 is connected to a vacuum source by means of vacuum hose 16 which is in fluid communication with a source of vacuum, such as, for example, a vacuum pump or negative air machine 82. The mixture of asbestos-containing material, water and air is aspirated from the cleaning head 10 through vacuum hose 16 into a disengagement apparatus such as a separator 84, as best illustrated in FIGS. 5 and 6. Any conventional equipment for disengaging entrained wet particulate material from air may be employed for this purpose, but the separator 84 operating on the principle of a cyclone is preferred for this purpose. The mixture of wet asbestos-containing material and air enters the top of the separator adjacent a periphery thereof, preferably tangentially at an oblique angle, e.g. about 45°, to induce a circular path of travel. The separator 84 is cylindrically shaped so that the entering mixture travels in a vortex within the separator 84 to disengage the wetted particulate material from the air. Air exits the top of the separator near the center thereof and is discharged via vacuum line 86 into a vacuum pump 88 equipped with a filter 90. The vacuum 88 and filter 90 arrangement may be any conventional negative air machine equipped with high efficiency particles absolute (HEPA) filters, e.g. 3 micron filters. Conventional negative air machines are available for this purpose, such as, for example, vacuum systems available under the trade designations Hako and Euroclean. By using such a vacuum filtration, asbestos particles not disengaged in the separator 84 are generally prevented from discharging into the ambient air at or below acceptable asbestos discharge levels by the vacuum filtration system. The residual asbestos particulates are generally collected in a filter bag in the vacuum filtration system in a conventional manner.

A distinct advantage of the separator 84 employed in the present invention is the provision of a simplified procedure for bagging the wetted asbestos-containing material for disposal. The preseparator or disengagement apparatus 84 employed in the vacuum system is preferably appropriately sized for conventional bags, such as, for example, 33 inch wide by 40 inch high 6 mil plastic disposal bags. The separator 84 is equipped with a lid 110 which is hinged in such a manner that the hinge 112 is attached to the separator body 114 a substantial distance below the top of the separator 84. This permits the lid 110 to be opened on the hinge 112 while a bag 116 to be filled with wetted asbestos-containing material is inserted into the separator body 114 and the uppermost portion of the bag is turned over the top of the separator body 114 around the periphery thereof, including the portion of the separator body 114 adjacent the hinge mechanism 112. The bag 116 is expanded to fill the separator body 114 by applying vacuum to the lowermost portion of the separator body 114. This is achieved by means of a line 118 connected to the lower portion of the separator 84 in fluid communication between the vacuum source 82 and the separator 84. In a preferred embodiment, this line is a flexible hose 118 running from a connection 120 at the top of the separator lid 110 to a lowermost portion of the separator body 114. The vacuum is applied by simply blocking the inlet to the vacuum system on the underside of the lid 110, for example, with the operator's hand. This readily expands the bag 116 to fit the contours of the separator body 114, thereby permitting the bag 116 to be filled to capacity and eliminating many problems typically associated with bagging under a vacuum situation.

When the lid 110 is closed, the line 118 serves to maintain an equilibrium pressure on either side of the bag 116 so that the bag 116 will not tend to collapse under the vacuum of the vacuum system 82. Similarly, when the bag 116 is filled to capacity with asbestos containing material, as indicated, for example, by a reduction in air velocity at the cleaning head 10, the bag 116 is removed by opening the lid 110 of the separator. The bag 116 may also be conveniently vacuum packed by taking the upper edges of the bag 116 and engaging a projection of the vacuum line connection 120 from the underside of the lid with the uppermost edges of the bag 116 shrouded around the projection by the hand of the operator. With the vacuum applied to the bag 116, the bag 116 is tied or sealed at the top thereof immediately below the depending projection of the connection 120. The bag 116 is then removed from the separator 84, preferably by means of opposed handles 150 secured to a removable support plate 152 disposed under the filled bag 116 and spaced from a bottom of the separator body 114 by one or more spacer elements 154 which also facilitate the vacuum enhanced bag expansion procedure discussed above, and a new bag is installed as described above for continued operation of the cleaning head.

In the operation of the asbestos removal and surface cleaning system, the layer A of asbestos-containing material on the surface S to be cleaned is preferably prewetted by spraying the asbestos containing material layer with water from a hose as is conventionally done preparatory to conventional manual scraping and washing procedures, but the system may also be used where the asbestos-containing material layer is dry. Prewetting the asbestos material provides better separation of the asbestos-containing material from the air in which it is aspirated into the separator 84, and further reduces water consumption, but results in a higher proportion of asbestos particles being collected in the vacuum system filter bag, and is therefore less preferred, since it is desired to retain the bulk of the asbestos containing material in the disengagement apparatus 84.

The apparatus is typically brought to the site, and may use on-site electrical connections for pump 130 and vacuum 82, and on-site water sources to fill, through line 103, the reservoir 102 which may be any suitable container, such as, for example, a 55 gallon drum. The water hoses 132 and 134 and vacuum hoses 16 and 86 are connected, any scaffolding is erected as necessary for access to the surface to be cleaned, and the negative air machine 82 and the high pressure water pump 130 are started up.

An operator 100 suited in appropriate protective gear moves the cleaning head 10 across the surface S to be cleaned of asbestos containing material, e.g. a wall or ceiling, by manipulating the cleansing head 10 with handles attached thereto (not shown), or alternatively, and preferably, with a trigger-type, hand-held valve 101 disposed in a rigid section of line 134 rigidly attached in turn to housing 12, preferably in trailing end wall 26, to facilitate pushing of the cleaning head 10 while at the same time facilitating on-off control of the water jet 43. As the cleaning head 10 travels across the surface S in engagement therewith, the knives 30, 32, 34 and 36 make generally continuous, parallel cuts or incisions into the asbestos-containing material layer A. These incisions are made down as close to the surface S to be cleaned as possible by pushing the cleaning head 10 against the surface. The knives 30, 32, 34, and 36 thus cut the asbestos-containing material layer A into parallel strips, preferably of less width than the diameter of the vacuum hose 16. These strips are then scraped from the surface S by the blade 40 in the cleaning head 10 trailing behind the knives 30, 32, 34 and 36. The blade 40 also serves to break up the asbestos material and may be assisted in this function by the planar-shaped water jet 43 directed just behind the trailing edge of the blade 40.

The planar shaped water jet 43 further cleans the scraped surface S to remove residual asbestos containing material. The amount of water which is consumed for this purpose is desirably kept to a minimum, preferably less than twenty percent by weight of the asbestos-containing material removed, since any water so used will normally be disposed of with the asbestos-containing material and it is desired to keep the quantity or rate of material to be disposed of at a minimum. On the other hand, a sufficient quantity of water should be used to obtain efficient cleaning of the surface S and to sufficiently wet the asbestos-containing material. Thus, the quantity of water used will generally depend on the amount of asbestos-containing material removed and the efficiency with which the water cleans the surface.

For the personnel-manipulated cleaning operation, in most instances the water consumption will be sufficient at a rate of from 1 to 2 gallons per minute, preferably about 1.5 gallons per minute. Where the surface to be cleaned is relatively smooth, as on concrete or steel, the cleaning head can be moved relatively quickly across the surface to be cleaned, e.g. 12 inches per second or more, but where the surface to be cleaned is relatively rough or textured, as with stucco or masonry surfaces, a slower head cleaning speed is preferably employed, e.g. approximately 4 inches per second to ensure adequate cleaning of the residual asbestos-containing material by the water jet spray 43 from the irregular surface. In any case, the amount of water used preferably does not exceed 20% of the weight of the asbestos-containing material removed.

The rate of removal of asbestos-containing material removed is in turn proportional to the thickness of the asbestos-containing material layer, the width of the cleaning head 10, i.e. the distance between the longitudinal walls 20 and 22, and the speed with which the cleaning head 10 is moved along the surface S. The thickness of the layer of asbestos-containing material is typically from 0.375 to as much as 2 inches or more. It has been found that a cleaning head 10 of from 3 to 6 inches in width may be moved by the operator 100 across the surface to be cleaned at a rate of from 4 to 12 or more inches per second, depending primarily upon the texture of the surface S. The maximum width of the cleaning head 10 is dictated by the strength of the operator 100 and the weight of the materials used for the construction thereof. It has been found that 6 inches of cleaning head 10 width is about the maximum desired width for the operator 100 to conveniently manipulate the cleaning head 10 across the surface S to be cleaned. Widths greater than this result in too much weight and resistance to facilitate manual manipulation, but such widths can be used where the cleaning head is guided on the surface by machinery or other supporting equipment, such as, for example, robots, winches, pulleys, and the like. Cleaning head widths under 3 inches, while easier for the operator 100 to manipulate, are less preferred because less material is removed by each pass of the cleaning head 10.

The removed asbestos-containing material and water is aspirated from the cleaning head 10 through the vacuum hose 16. Sufficient air flow should be maintained to avoid or minimize the escape of any asbestos-containing material from the head cleaning apparatus 10. For a 3 to 6 inches wide cleaning head 10, using a 3 inch vacuum hose 16, it has been found that air volumes of 200 to 300 cubic feet per minute, preferably from 240 to 270 cubic feet per minute, are sufficient for this purpose. Of course, if a smaller cleaning head 10 were used, less air would be required, and if a larger cleaning head 10 were used, a larger entrainment air volume would be needed.

Using the present invention, it has been found that one man can clean usually at least 10 square feet per minute, and sometimes as much as 30 square feet per minute or more, depending primarily upon the texture of the surface to be cleaned and, to a lesser degree, the condition of the asbestos-containing material layer A to be removed. This is a significant breakthrough in asbestos removal and cleaning speed compared to the prior art techniques which might require as much or more than 1 man hour per square foot for removal of asbestos-containing material and cleaning of the surface S. In addition, it has been found that the surface cleaned according to the present invention contains less residual asbestos-containing material than surfaces which have been hand washed. This is an additional and surprising advantage because the need for laboriously hand washing the surface after scraping the asbestos-containing material layer therefrom is altogether eliminated by the present invention.

The invention is described hereinabove by way of illustration and example, and many variations in the size, shape, and materials will occur to those skilled in the art. It is intended that all such modifications which fall within the scope and spirit of the appended claims be embraced thereby.

What is claimed is:

1. A device for removing and cleaning relatively softer material from a relatively harder surface, comprising:

a housing having an open face for moving in a longitudinal path along a surface having a soft material layer deposited thereon, said face including a leading edge spaced from said surface to clear said soft material layer;

means associated with said open face for making a plurality of substantially continuous parallel longitudinal incisions in said soft material layer as said open face is moved in said path along said surface;

means associated with said open face for scraping said soft material layer between said incisions from said surface to remove the bulk of said soft material therefrom;

means associated with said housing for washing said scraped surface to remove residual soft material therefrom; and means associated with said housing for aspirating said removed soft material into a collection receptacle.

2. A device for removing and cleaning asbestos-containing material from a surface, comprising:

a housing having an open face adapted to move in a longitudinal path along a surface having asbestos-containing material layer thereon said face including a leading edge spaced form said surface to clear said layer;

a plurality of knives disposed adjacent said open face for making a plurality of substantially continuous parallel incisions in said asbestos-containing material layer as said face is moved along said surface;

a blade disposed adjacent said open face transversely to said longitudinal incisions for scraping said asbestos-containing material layer between said incisions from said surface;

a distributor mounted to said housing for spraying liquid from a pressurized source thereof onto said scraped surface for removing residual asbestos-containing material therefrom; and a vacuum source connected to said housing for aspirating said sprayed liquid and asbestos-containing material removed by said scraping and spraying.

3. The device of claim 2, wherein said housing includes a pair of longitudinal side wall members on opposite sides of said housing.

4. The device of claim 3, wherein said knives include respective knives disposed at an edge of each said longitudinal wall members adjacent said face.

5. The device of claim 4, wherein said knives include a wheel knife rotatably disposed between said longitudinal wall members.

6. The device of claim 3, wherein said blade has opposite ends respectively affixed to said longitudinal wall members.

7. The device of claim 2, wherein said distributor is mounted inside said housing and is adapted to spray said liquid in a transverse sheet directed adjacent said blade.

8. The device of claim 2, further comprising a separator connected to said housing with a vacuum hose for collecting a mixture of said liquid and said asbestos containing material aspirated from said housing.

9. The device of claim 8, wherein said separator includes a removable bag in which said mixture is collected.

10. The device of claim 8, wherein said vacuum source is attached to said separator in series with said housing.

11. The device of claim 10, wherein said vacuum source includes a vacuum pump and a particulate filter.

12. A method of removing and cleaning soft material from a surface, comprising the steps of:

making a plurality of substantially continuous, parallel longitudinal incisions in a soft material layer deposited onto a surface;

scraping said soft material layer from said surface between said incisions;

spraying liquid from a pressurized source thereof onto said scraped surface to remove residual soft material therefrom; and aspirating said sprayed liquid and said scraped and removed soft material together into a collection receptacle.

13. The method of claim 12, wherein said soft material layer comprises asbestos-containing material.

14. The method of claim 13, wherein said incisions are made by a plurality of knives disposed adjacent an open face of a housing adapted to move in a longitudinal path along said surface.

15. The method of claim 14, wherein said scraping is with a blade disposed in said housing transversely to said longitudinal incisions adjacent a trailing side of said knives.

16. The method of claim 15, wherein said spraying includes supplying a pressurized source of said liquid to a distributor mounted in said housing for directing a planar-shaped jet of said liquid onto said surface adjacent a trailing side of said blade.

17. The method of claim 16, wherein said aspiration includes applying a vacuum inside said housing with a vacuum source connected to said housing.

18. The method of claim 16, wherein said jet impinges said scraped surface at an oblique angle.

* * * * *